United States Patent [19]

Fischer

[11] 4,172,543

[45] Oct. 30, 1979

[54] RESILIENT ATTACHMENT CLIP

[75] Inventor: Kurt Fischer, Bern, Switzerland

[73] Assignee: Hasler AG, Bern, Switzerland

[21] Appl. No.: 862,639

[22] Filed: Dec. 20, 1977

[30] Foreign Application Priority Data

Jan. 25, 1977 [CH] Switzerland ..... 853/77

[51] Int. Cl.[2] ..... A45C 1/04

[52] U.S. Cl. .....224/268; 224/269

[58] Field of Search ..... 224/26 R, 26 B, 26 D, 224/5 R, 5 H, 25 R, 5 A, 5 C, 5 D, 5 G, 5 J, 5 L, 5 V, 13, 21, 20, 28 B, 28 R, 28 D; 24/3 R, 3 C, 3 D, 3 F, 3 G, 3 H, 3 J, 3 L, 76, 255

[56] References Cited

U.S. PATENT DOCUMENTS

| | | | |
|---|---|---|---|
| 1,144,087 | 6/1915 | Adler | 224/5 H |
| 1,705,595 | 3/1929 | Traeger | 24/3 L |
| 1,966,019 | 7/1934 | Mishey | 224/5 R |
| 2,262,340 | 11/1941 | Shalko | 24/3 G |
| 2,514,834 | 7/1950 | Bostian | 24/3 G |
| 2,839,831 | 6/1958 | Baer | 224/5 A X |

*Primary Examiner*—Robert J. Spar
*Assistant Examiner*—Jerold M. Forsberg
*Attorney, Agent, or Firm*—Brady, O'Boyle & Gates

[57] ABSTRACT

A resilient wire attachment clip has two respective longitudinally extending; elongated, loop portions positioned in two mutually parallel planes, each of the loops formed by an internal limb and an external limb connected by a resilient arc portion that extends through a slot in a housing wall, the external limbs of the two loop portions normally lying within a pair of parallel grooves on the exterior of the housing wall with the ends of the external limbs connected by a transversely extending portion that is spaced outwardly from the housing wall, the internal limbs of the two loop portions have hook-shaped free ends which with slight prestress engage two abutments on the interior of the housing wall to support the clip between the two abutments and the interior surface of the housing wall at the point of an interiorly directed bend in the internal limbs, with the major portion of the diameter of the loop arc portions positioned interior of the housing wall.

5 Claims, 4 Drawing Figures

RESILIENT ATTACHMENT CLIP

BACKGROUND OF THE INVENTION

1. Field of The Invention

This invention relates to an appliance having a clip whereby it can be attached to clothing. The appliance can be a hearing aid, or a calculator, or a tape recorder or, more particularly, a receiver of a radio paging system.

2. Description of The Prior Art

Fountain pens and ball-point pens often have such clips and embodiments are descrbied in German Pat. No. 2532204 and U.S. Pat. No. 1,646,742. In these embodiments, a clamping arm of the clip butts closely against the pen wall or is sunk into the wall. Clamping arms of the clip are rigid and connected to a resilient element. Through finger pressure on an upper part of the arms, these can be forced into the interior of the housing, whereby the lower end of the arms lifts away from the surface of the pen. In this way the clip can be engaged even with webs of material that are quite thick.

The advantage of such clips is that easier fastening of the pen to both thin and thick webs of material on clothing is possible. However, this advantage is offset by the fact that the clip must have several individual parts which are considerably more expensive to produce than the otherwise conventional clips which are one-piece.

British Pat. No. 625,157 describes clips of resilient wire. By bending, various clip shapes can be produced. The fastening of the clips is effected by inserting or hooking the wire ends into associated holes of the pins or by lateral pushing over a planar element.

U.S. Pat. No. 2,514,834 describes a spectacle case having clips produced from a spring plate. The clip is fastened to the case by means of three holes, into which the clip is inserted during assembly, in order to be protected against dropping out by bending over its one end.

In the case of such appliances or other equipment which has to be worn from time to time on the clothing (for example, radio staff locator receivers), the fastening to the clothing has to be such that the appliances can be easily fastened and removed, but during use are firmly seated.

This requires, upon fastening with the aid of a clip, depending on the weight of the appliances, considerably greater holding forces than are customary in the case of pen or spectacle case clips.

SUMMARY OF THE INVENTION

An object of the present invention is to provide a clip arrangement for a small appliance which is simple to handle, cheap to produce and, with respect to its clamping properties, operates well independently of the thickness and the quality of clothing to which it may be attached.

The invention provides a clip for an appliance whereby the appliance can be attached to clothing, the clip being of resilient wire, and projecting from apertures in a housing wall of the appliance wherein: the resilient wire is bent in such a way that in two mutually parallel planes two respective hair-grip-shaped loops are formed, which loops are connected together by a central piece of the wire and the free ends of which are bent aside in hook-shaped manner; there is arranged in the interior of the housing two abutments in which the free loop ends are hooked with slight prestress in such a way that they are supported on the abutment and on the inner surface of the housing wall; the housing wall has, on its outside, two parallel grooves and two slots constituting said apertures; the two loops project with their arcs through the slots and, in the position of relaxation of the wire; the central piece of the wire on the outside of the housing wall is spaced from the housing wall outer surface and the limbs of the loops, connected by the central pieces, lie in the two parallel grooves.

BRIEF DESCRIPTION OF THE DRAWINGS

The invention will be described further by way of example, with reference to the accompanying drawings, in which.

Description of The Preferred Embodiment

Figure 1:
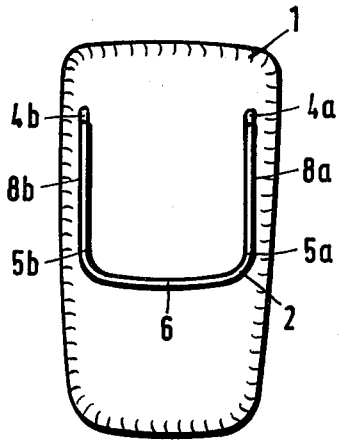
FIG. 1 is an external plan view of a preferred arrangement of an appliance clip of the invention on a housing wall of an appliance.

FIG. 1 is an external view of a small appliance which is to be worn on the clothing, for example, during working hours. For this purpose, the appliance 1 has a clip 2. This is intended to make it possible to fasten the appliance 1 to the clothing of the wearer. Preferred fastening points on the clothing are jacket pockets, shirt pockets, ties, and so forth. The thickness of these textiles fastening points can be very different and varies from 1/10th mm up to several millimeters.

Figure 2:
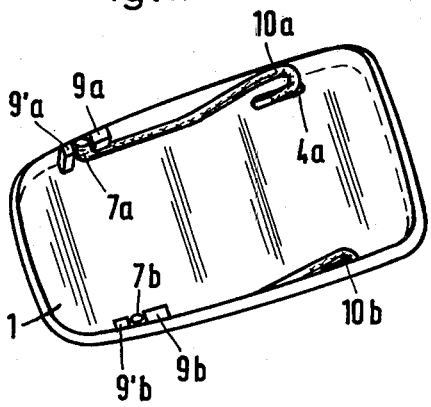
FIG. 2 is an internal perspective view of the appliance housing wall and clip.
Figure 3:
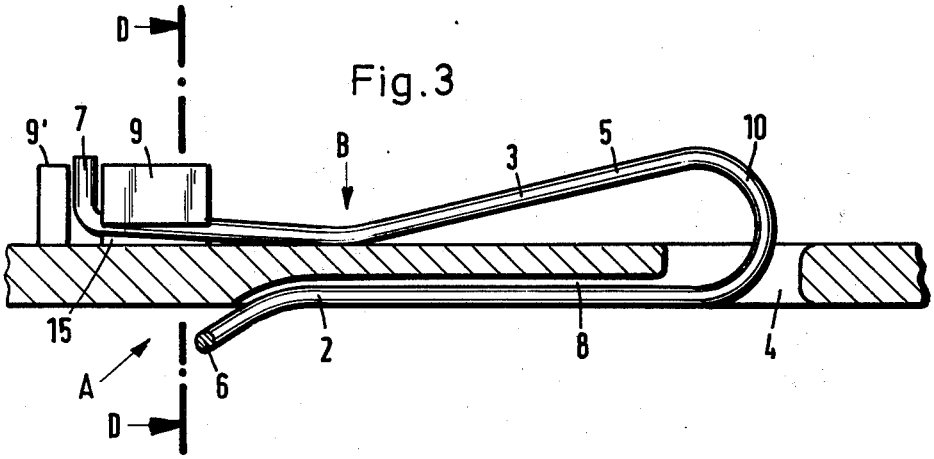
FIG. 3 is an enlarged fragmentary cross-sectional view through a housing wall of the appliance.

FIG. 2 is an internal view showing the housing wall or body portion of the appliance and the clip 2 connected thereto. In FIG. 3 there is finally shown a section through that wall of the appliance of body portion which carries the clip. The clip 2 is formed from a single bent spring wire and extends through two slots **4*a* and 4*b*** from the appliance interior to the appliance exterior.

The wire is bent in such a way that in two mutually parallel planes a respective hair-clip-shaped or U-shaped loop **5*a*, 5*b* is formed. These two loops are connected on the outside of the small appliance by a central connecting portion or piece 6 of the wire. The two free ends 7*a* and 7*b*** of the wire finally are bent to form hooks.

In the interior of the appliance there are arranged two abutments **9*a* and 9*b*, into which the hook-shaped loop ends 7*a* and 7*b*** are engaged with a slight prestress.

On the outside of the appliance the spring wire is U-shaped, when viewed in plan, with the loops **5*a* and 5*b* forming the parallel exterior limbs of the "U" and the central piece 6 forming the base of the "U". The two limbs of the "U" lie in two grooves 8*a* and 8*b*, respectively in the outer wall of the housing. Thus, only the central piece 6 of the spring wire protrudes, in its state of rest, beyond the outer surface of the wall of the housing as shown in FIG. 3**. This allows simple attachment of the appliance to clothing.

The parts of the wire lying substantially within the two slots **4*a* and 4*b* form the arcs or bight portions 10*a* and 10*b* of the hair-grip-shaped loops 5*a* and 5*b***, the diameters of these bight portions being substantially larger than the thickness of the housing wall and the greater portion of the bight portions positioned interior of the housng wall.

If, at the point designated A in FIG. 3, a textile web is pushed in, this raises through the central piece 6 of the wire the external parallel limbs of the loops 5*a* and 5*b* out of the grooves 8*a* and 8*b*. In this way, the textile web can be advanced up to the arcs 10*a* and 10*b*. With such an operation there is effected a deformation of the spring wire over the entire length of the internal loop's limbs.

Finally, the textile web is clamped, resiliently between the two grooves 8*a* and 8*b* and the external limbs, in which respect thin materials are pressed partially into the grooves which considerably increases the friction. In the case of thick materials, on the other hand, the spring force is so highly increased by the more severe deformation that in this case also, a sufficiently great friction is present to hold the appliance in secure position.

Figure 4:
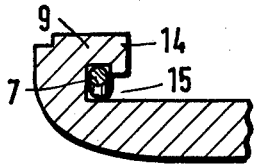
FIG. 4 is a fragmentary cross-sectional view taken substantially on the line D—D of FIG. 3.

As shown in FIG. 4, the abutments 9*a* and 9*b* consist of hook-shaped parts 14 which are connected to lateral housing walls and are effectively cantilevered from the side walls to form slots or passages 15 thereunder between the abutments 9 and the inner side of the body portion. The loop ends 7*a* and 7*b* are pushed in via the slots 15 and pass, because of their initial prestress, into the depicted position in the grooves under the abutments and in communication with the slots 15. The prestress acts in such a way that both in the position of rest and in the working position the loop ends are supported on the one hand beneath the hook-shaped part 14 and on the other hand, at the point designated B in FIG. 3, where the internal parallel limbs 5 of the wire 3 bear against the inner surface of the housing wall or body portion at the point of bend in the limbs. This support cannot be cancelled by any movement of the clip on the outside of the housing.

The longitudinal displacement of the clip along the grooves 8 is prevented by the hook-shaped wire ends 7*a* and 7*b* positioned in close proximity to the abutment stops 9'.

The appliance attaches equally well to thick and thin materials. The clip is simple, consisting substantially of a single spring wire. In price respects, this is very favorable, particularly taking into consideration the simple assembly which is effected merely by inserting the spring wire 3 through the apertures 4*a* and 4*b* and hooking the wire ends 7*a* and 7*b* into the abutments 9*a* and 9*b* and adjacent the stops 9'.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A resilient wire clip in combination with a body portion for attaching the body portion to clothing or the like, comprising a body portion having a pair of spaced apertures therethrough, a pair of U-shaped loop portions forming the sides of the resilient wire clip and positioned in spaced parallel planes at substantially right angles to the plane of said body portion;

the U-shaped loop portions including inner leg portions positioned on the inner side of said body portion and outer leg portions positioned on the outer side of said body portion joined by bight portions which extend through the spaced apertures in said body portion;

said body portion having a pair of parallel grooves in its outer surface in aligment with said pair of spaced apertures;

said outer leg portions positioned in said grooves in the position of relaxation of the resilient wire clip;

a central portion (6) joining the ends of the outer leg portions of the pair of U-shaped loop portions of the resilient wire clip and being spaced from the outer surface of said body portion;

said inner leg portions having free ends terminating in hook-shaped portions, a pair of abutments on the inner side of said body portion, said hook-shaped portions engaged with said pair of abutments and said inner leg portions having a medial portion in contact with the inner side of said body portion to slightly prestress said resilient wire clip and position said outer leg portions in said grooves.

2. A resilient wire clip as set forth in claim 1 in which said pair of abutments (9*a*,9*b*) are spaced from the inner side of said body portion to form a passage therebetween in which said wire is engaged.

3. A resilient wire clip as set forth in claim 2 in which said pair of abutments (9*a*,9*b*) have lower surfaces carrying wire engaging grooves in communication with said passages.

4. A resilient wire clip as set forth in claim 2 including abutment stops (9') on the inner side of said body portion spaced from said pair of abutments and said hook-shaped portions (7*a*,7*b*) positioned between said pair of abutments and said abutment stops.

5. A resilient wire clip as set forth in claim 1 in which a substantial portion of the diameter of said bight portions (10*a*,10*b*) are positioned interior of said body portion.

* * * * *